US006501010B2

(12) United States Patent
Sullivan

(10) Patent No.: US 6,501,010 B2
(45) Date of Patent: Dec. 31, 2002

(54) REED AND MOUTHPIECE ASSEMBLY

(76) Inventor: George V. Sullivan, 71 Hopmeadow St., Condo #7A1, Weatoque, CT (US) 06089

( * ) Notice: Subject to any disclaimer, the term of this patent is extended or adjusted under 35 U.S.C. 154(b) by 4 days.

(21) Appl. No.: 09/884,192

(22) Filed: Jun. 19, 2001

(65) Prior Publication Data

US 2002/0002894 A1 Jan. 10, 2002

Related U.S. Application Data

(60) Provisional application No. 60/217,203, filed on Jul. 10, 2000.

(51) Int. Cl.[7] ..... G10D 9/02
(52) U.S. Cl. ..... 84/383 A; 84/383 A
(58) Field of Search ..... 84/383 R, 383 A

(56) References Cited

U.S. PATENT DOCUMENTS

| | | | | |
|---|---|---|---|---|
| 147,202 | A | | 2/1874 | Vogel |
| 477,661 | A | | 6/1892 | Janes |
| 488,828 | A | | 12/1892 | Mudge |
| 555,561 | A | | 3/1896 | Cadwallader |
| 1,506,364 | A | | 8/1924 | Chiron et al. |
| 1,535,537 | A | | 4/1925 | Majeski |
| 1,615,549 | A | | 1/1927 | Miller |
| 1,667,836 | A | | 5/1928 | Brockman, Jr. |
| 1,776,566 | A | | 9/1930 | Newton et al. |
| 1,779,522 | A | | 10/1930 | Widmayer |
| 1,789,639 | A | * | 1/1931 | Selmer ..... 84/383 R |
| 2,106,016 | A | | 1/1938 | Prescott |
| D119,602 | S | | 3/1940 | Veruille |
| 2,193,976 | A | * | 3/1940 | Malbon ..... 84/383 R |
| 2,268,641 | A | | 1/1942 | Brilhart |
| 2,287,529 | A | | 6/1942 | MacCaferri |
| 2,342,836 | A | | 2/1944 | Brilhart |
| 2,375,934 | A | | 5/1945 | Lucas |
| 2,467,921 | A | * | 4/1949 | Werner ..... 84/283 R |
| 2,492,366 | A | | 12/1949 | Ohnhaus |
| 2,669,897 | A | | 2/1954 | Topor |
| 3,183,760 | A | | 5/1965 | Michel |
| 3,202,032 | A | | 8/1965 | Strathmann |
| 3,564,965 | A | | 2/1971 | Carliwi et al. |
| 3,905,268 | A | | 9/1975 | Gamble |
| 4,056,997 | A | | 11/1977 | Rovner |
| 4,145,949 | A | | 3/1979 | Kilian |
| 4,172,482 | A | | 10/1979 | Gomez |
| 4,212,223 | A | | 7/1980 | Runyon |
| 4,337,683 | A | | 7/1982 | Backus |
| 4,355,560 | A | | 10/1982 | Shaffer |
| 4,449,439 | A | | 5/1984 | Wells |
| 4,572,257 | A | | 2/1986 | Laker |
| 4,644,649 | A | | 2/1987 | Seaman et al. |
| 4,796,507 | A | | 1/1989 | Stibal |
| 4,941,385 | A | | 7/1990 | Johnson |
| 4,991,483 | A | | 2/1991 | Petit |
| 5,000,073 | A | | 3/1991 | Hite |
| 5,018,425 | A | | 5/1991 | Rovner |
| 5,033,350 | A | | 7/1991 | Galper |
| 5,105,701 | A | | 4/1992 | Hall et al. |
| 5,289,752 | A | | 3/1994 | Barabaglia |
| 5,398,582 | A | | 3/1995 | Smith |
| 5,456,152 | A | | 10/1995 | Cusack et al. |
| 5,479,842 | A | | 1/1996 | Ostermeyer |
| 5,648,623 | A | | 7/1997 | Silverstein et al. |
| 6,020,545 | A | | 2/2000 | Consoli |

* cited by examiner

*Primary Examiner*—Shih-Yung Hsieh
(74) *Attorney, Agent, or Firm*—Sperry, Zoda & Kane

(57) ABSTRACT

The present invention provides a unique configuration for a reed and mouthpiece for a woodwind instrument wherein the reed is formed with a special configuration having a slot in the non-vibrating clamped portion to facilitate mounting thereof with respect to a uniquely configured mouthpiece of a woodwind instrument such as a clarinet or saxophone. A uniquely configured mouthpiece in combination with a uniquely configured reed provides a unique method for self-aligning and self-centering installation of a reed which eliminates the requirement of a conventional ligature and provides for faster and easier installation of a reed to a woodwind mouthpiece. Correct installation is quickly and easily achieved even by those unskilled such as young beginners.

20 Claims, 4 Drawing Sheets

REED AND MOUTHPIECE ASSEMBLY

This application claims priority rights of U.S. provisional patent application No. 60/217,203, filed Jul. 10, 2000 entitled "Reed And Mouthpiece Assembly" by the same applicant herein, namely, George V. Sullivan.

BACKGROUND OF THE INVENTION

1. Field of the Invention

The present invention deals with the field of musical instruments and, in particular, woodwind instruments, such as clarinets and saxophones, which utilize a moistened reed during the performance thereof. Such reeds are typically installed and removed before and after each playing session and also during performances if they become unusable for any reason. Using current methods, this process can prove difficult and time consuming especially for beginners or when quickness is needed such as during a performance.

The reed must be properly aligned with respect to the mouthpiece in such a manner that proper tone is produced by the instrument. The present invention provides a self-aligning, self-centering means for rapidly and easily replacing such a reed without requiring a conventional ligature, with which reed replacement can be difficult and time consuming.

2. Description of the Prior Art

Various configurations have been designed for mouthpieces and reeds for musical instruments, usually woodwind instruments, such as shown in U.S. Pat. No. 147,202 patented Feb. 3, 1874 to C. W. Vogel on "Reed-Organs"; and U.S. Pat. No. 477,661 patented Jun. 28, 1892 to H. Janes on a "Vibrator For Reed Musical Instruments"; and U.S. Pat. No. 488,828 patented Dec. 27, 1892 to C. S. Mudge on a "Musical Instrument"; and U.S. Pat. No. 555,561 patented Mar. 3, 1896 to G. R. Cadwallader on a "Reed Supporter For Clarinets"; and U.S. Pat. No. 1,506,364 patented Aug. 26, 1924 to H. M, Chiron et al on a "Reed For Saxophone Or Clarinet Mouth Pieces"; and U.S. Pat. No. 1,535,537 patented Apr. 28, 1925 to W. Majeski an "Adjustable Reed In Wind Instruments"; and U.S. Pat. No. 1,615,549 patented Jan. 25, 1927 to B. Miller on a "Mouthpiece For Reed Instruments"; and U.S. Pat. No. 1,667,836 patented May 1, 1928 to F. Brockman, Jr. on a "Reed For Musical Wind Instruments"; and U.S. Pat. No. 1,776,566 patented Sep. 23, 1930 to H. B. Newton et al on a "Mouth Reed For Musical Instruments"; and U.S. Pat. No. 1,779,522 patented Oct. 28, 1930 to C. O. Widmayer on a "Reed For Clarinets And Saxophones"; and U.S. Pat. No. 2,106,016 patented Jan. 18, 1938 to H. T. Prescott on a "Reed For Musical Instruments"; and U.S. Design Pat. No. Des.112,783 patented Jan. 3, 1939 to O. C. Noble and assigned to Tygart Valley Glass Company on a "Jar"; and U.S. Design Pat. No. Des.119,602 patented Mar. 26, 1940 to A. A. Verville on a "Reed For A Musical Instrument"; and U.S. Pat. No. 2,268,641 patented Jan. 6, 1942 to A. Brilhart on a "Reed For Musical Instruments"; and U.S. Pat. No. 2,287,529 patented Jun. 23, 1942 to M. Maccaferri on a "Reed Of Cane, Plastic, Or Any Other Material For Clarinets, Saxophones, And Like Musical Instruments"; and U.S. Pat. No. 2,342,836 patented Feb. 29, 1944 to A. Brilhart and assigned to Arnold Brilhart Ltd. on a "Reed For Musical Instruments"; and U.S. Pat. No. 2,375,934 patented May 15, 1945 on a "Reed"; and U.S. Pat. No. 2,492,366 patented Dec. 27, 1949 to A. L. Ohnhaus on a "Wood-Wind Reed"; and U.S. Pat. No. 2,669,897 patented Feb. 23, 1954 to J. Topor on a "Reed For Musical Instruments"; and U.S. Pat. No. 3,183,760 patented May 18, 1965 to A. Michel on "Reeds For Application In Musical Instruments Particularly In Electronic Musical Instruments"; and U.S. Pat. No. 3,202,032 patented Aug. 24, 1965 to A. R. Strathmann on a "Mouthpiece For Saxophones And Clarinets"; and U.S. Pat. No. 3,564,965 patented Feb. 23, 1971 to J. A. Carlini on a "Ligature For Reed Musical Instrument"; and U.S. Pat. No. 3,905,268 patented Sep. 16, 1975 to J. G. Gamble on "Reeds For Saxophones, Clarinets And Other Woodwinds"; and U.S. Pat. No. 4,056,997 patented Nov. 8, 1977 to P. L. Rovner on a "Reed Holding Device For Musical Instruments"; and U.S. Pat. No. 4,145,949 patented Mar. 27, 1979 to F. A. Kilian on a "Musical Reed"; and U.S. Pat. No. 4,172,482 patented Oct. 30, 1979 to H. M. Gomez on a "Method And Apparatus For Adjusting Single Reeds For Musical Instruments"; and U.S. Pat. No. 4,337,683 patented Jul. 6, 1982 to J. G. Backus on a "Synthetic Woodwind Instrument Reed And Method For Its Manufacture"; and U.S. Pat. No. 4,355,560 patented Oct. 26, 1982 to D. W. Shaffer on a "Reed Construction"; and U.S. Pat. No. 4,449,439 patented May 22, 1984 to F. E. Wells on a "Mouthpiece For Woodwind Instruments"; and U.S. Pat. No. 4,572,257 patented Feb. 25, 1986 to E. B. Laker on an "Apparatus For Profiling Reeds For Double-Reed Musical Instruments"; and U.S. Pat. No. 4,644,649 patented Feb. 24, 1987 to R. C. Seaman et al on an "Apparatus For Trimming Reeds Of Musical Instruments"; and U.S. Pat. No. 4,796,507 patented Jan. 10, 1989 to T. L. Stibal on a "Reed Holding Device"; and U.S. Pat. No. 4,941,385 patented Jul. 17, 1990 to C. O. Johnson on a "Tone Plate And Clamping Device For A Musical Instrument Mouthpiece"; and U.S. Pat. No. 4,991,483 patented Feb. 12, 1991 to R. Petit on a "Mouthpiece For Wind Instrument, And Corresponding Ligature And Mouthpiece Cover"; and U.S. Pat. No. 5,000,073 patented Mar. 19, 1991 to D. Hite on a "Construction For Supporting A Reed Upon The Mouthpiece Of A Musical Wind Instrument And Method Of Fabricating The Same"; and U.S. Pat. No. 5,018,425 patented to P. L. Rovner on May 28, 1991 on a "Mouthpiece System For Woodwind Instruments"; and U.S. Pat. No. 5,033,350 patented Jul. 23, 1991 to A. Galper on a "Single Reed Mouthpiece"; and U.S. Pat. No. 5,105,701 patented Apr. 21, 1992 to J. Hall et al on a Clarinet Mouthpiece"; and U.S. Pat. No. 289,752 patented Mar. 1, 1994 to E. Barbaglia on a "Device For Fastening The Reed On The Mouthpiece of Wind Instruments"; and U.S. Pat. No. 5,398,582 patented Mar. 21, 1995 to G. T. Smith and assigned to Mobile Music, Inc., Gary Smith and Joseph Stefano on a "Wire Clamping Ligature For Use With A Single Reed Mouthpiece For A Musical Instrument"; and U.S. Pat. No. 5,479,842 patented Jan. 2, 1996 to W. H. Ostermeyer on "Flavored Musical Instrument Reeds"; and U.S. Pat. No. 6,020,545 patented Feb. 1, 2000 to J. J. Consoli on a "Ligature For The Mouthpiece Of A Woodwind Musical Instrument".

SUMMARY OF THE INVENTION

The present invention provides a unique configuration for a reed and mouthpiece assembly which when utilized together provide an improved means for the attaching of a reed with respect to a woodwind instrument mouthpiece which is self-aligning both vertically and horizontally and which can easily and quickly be installed. Also this configuration is particularly easy for those inexperienced in replacing such reeds such as young persons in their initial stages of learning how to play a woodwind musical instrument. The design makes use of a reed having a unique configuration which includes a reed slot for securement and alignment to a uniquely configured mouthpiece.

In particular, the present invention includes a specially designed reed and mouthpiece assembly used with a woodwind musical instrument such as a saxophone or clarinet. The mouthpiece itself includes a mouthpiece body with an air conduit extending longitudinally therethrough for providing a vibrating air column for the playing of the instrument. A reed placement surface is defined on the mouthpiece body adjacent the air conduit and is adapted to receive a reed detachably secured thereagainst. This reed placement surface is preferably oriented parallel with respect to the air conduit.

A reed is included which includes a specially configured reed slot which extends therealong. The reed is adapted to be detachably secured to the reed placement surface adjacent the air conduit of a mouthpiece body to control air flow therethrough. The reed is preferably oriented extending parallel with respect to the air conduit. The reed slot also preferably is outwardly flared in the end portions thereof to facilitate movement to alignment with respect to a mounting stud. The reed is also preferably beveled downwardly adjacent the reed slot to facilitate movement thereof beneath a pressure plate.

A self-aligning reed securement configuration is attached to the mouthpiece and is adapted to selectively retain the reed in proper alignment on the placement surface. This self-aligning reed securement configuration preferably includes a mounting stud secured to the reed placement surface and extending outwardly therefrom. The mounting stud is adapted to extend through the reed slot to facilitate alignment thereof when the reed is positioned on the reed placement surface. The mounting stud also preferably includes a mounting thread means defined thereon.

A tightening device is engageable with respect to the mounting threads and is detachably secured to the mounting stud to be movable therealong. The tightening device is adapted to exert a force selectively toward the reed for retaining it in engagement with respect to the placement surface in such a manner that the reed is positioned with the mounting stud extending through the reed slot. The tightening device includes a knob preferably which is engageable with respect to the mounting threads defined on the mounting stud to aid in directing force toward the reed for retaining it in engagement with respect to the mouthpiece. This knob device is adjustably positionable with respect to the mounting threads of the mounting stud to allow adjustable control of the force directed onto the reed and to facilitate removal and replacement thereof. The knob preferably will include a knurled external surface extending therearound to further facilitate tightening and loosening thereof.

An alignment spine may be included extending upwardly from the reed placement surface in such a manner as to be positioned within the reed slot of the reed when it is located on the placement surface to enhance alignment between the reed and the mouthpiece. The alignment spine is preferably oriented extending parallel with respect to the reed slot and with respect to the air conduit. The alignment spine further defines a tab means extending further outwardly preferably in an upward direction therefrom.

A pressure plate is included positioned between the tightening knob and the reed to facilitate retaining the reed in position with respect to the mouthpiece. This pressure plate defines a pressure plate hole extending therethrough which is adapted to receive the mounting stud thereinto to facilitate placement between the tightening knob and the reed. The pressure plate preferably defines a pressure plate notch to facilitate the tab of the alignment spine to maintain longitudinal alignment between the pressure plate and the mouthpiece itself. This pressure plate preferably includes a first leg member which extends downwardly and longitudinally therealong as well as a second leg member which extends downwardly and longitudinally therealong at a position spatially disposed from the first leg member to define therebetween a reed retaining cavity within the pressure plate. This reed retaining cavity will facilitate holding of the reed in position properly aligned in abutment with respect to the reed placement surface. A plurality of protrusion means may be included extending downwardly from the pressure plate into the retaining cavity between the first leg member and the second leg member in order to abut the reed when positioned within the reed retaining cavity to facilitate holding thereof.

It is an object of the present invention to provide a unique configuration for a reed and mouthpiece assembly for a woodwind instrument which is self-aligning and usable with any type of woodwind instrument wherein the need for a ligature is eliminated.

It is an object of the present invention to provide a unique configuration for a reed and mouthpiece assembly for a woodwind instrument which is self-aligning and usable with any type of woodwind instrument wherein faster installation of the reed is made possible.

It is an object of the present invention to provide a unique configuration for a reed and mouthpiece assembly wherein removal and properly aligned installation of a reed with respect to the reed placement surface of a mouthpiece is made easier.

It is an object of the present invention to provide a unique configuration for a reed and mouthpiece assembly for a woodwind instrument which is self-aligning and usable with any type of woodwind instrument wherein alignment is achieved both vertically and horizontally during placement of the reed.

It is an object of the present invention to provide a unique configuration for a reed and mouthpiece assembly for a woodwind instrument which is self-aligning and usable with any type of woodwind instrument wherein the reed is placed more accurately.

It is an object of the present invention to provide a unique configuration for a reed and mouthpiece assembly for a woodwind instrument which is self-aligning and usable with any type of woodwind instrument wherein the cost of the equipment is minimal.

It is an object of the present invention to provide a unique configuration for a reed and mouthpiece assembly for a woodwind instrument which is self-aligning and usable with any type of woodwind instrument wherein there is a minimum number of moving parts.

It is an object of the present invention to provide a unique configuration for a reed and mouthpiece assembly for a woodwind instrument which is self-aligning and usable with any type of woodwind instrument wherein breakage is minimized.

It is an object of the present invention to provide a unique configuration for a reed and mouthpiece assembly for a woodwind instrument which is self-aligning and usable with any type of woodwind instrument wherein the possibility of installing the reed incorrectly is virtually eliminated.

It is an object of the present invention to provide a unique configuration for a reed and mouthpiece assembly for a woodwind instrument which is self-aligning and usable with any type of woodwind instrument wherein frustration which often occurs with new musicians is minimized.

It is an object of the present invention to provide a unique configuration for a reed and mouthpiece assembly for a woodwind instrument which is self-aligning and usable with any type of woodwind instrument wherein there is no requirement that both the reed and the ligature be handled at the same time.

It is an object of the present invention to provide a unique configuration for a reed and mouthpiece assembly for a woodwind instrument which is self-aligning and usable with any type of woodwind instrument wherein breaking of the reed while placing it in the ligature is no longer a problem.

It is an object of the present invention to provide a unique configuration for a reed and mouthpiece assembly for a woodwind instrument which is self-aligning and usable with any type of woodwind instrument wherein reed life is significantly extended.

It is an object of the present invention to provide a unique configuration for a reed and mouthpiece assembly for a woodwind instrument which is self-aligning and usable with any type of woodwind instrument wherein only a single tightening mechanism such as a screw or knob can be used for securing the reed to the mouthpiece rather than conventional ligature which requires two such tightening mechanisms.

It is an object of the present invention to provide a unique configuration for a reed and mouthpiece assembly for a woodwind instrument which is self-aligning and usable with any type of woodwind instrument wherein mouthpiece life is prolonged.

It is an object of the present invention to provide a unique configuration for a reed and mouthpiece assembly for a woodwind instrument which is self-aligning and usable with any type of woodwind instrument wherein misplacement of a ligature is no longer a problem.

It is an object of the present invention to provide a unique configuration for a reed and mouthpiece assembly for a woodwind instrument which is self-aligning and usable with any type of woodwind instrument wherein accidental loosening of the ligature during playing of the instrument is no longer a problem.

It is an object of the present invention to provide a unique configuration for a reed and mouthpiece assembly for a woodwind instrument which is self-aligning and usable with any type of woodwind instrument wherein children can have a more positive attitude relative to playing woodwind musical instruments because they are not discouraged by the difficulty often incurred in the correct placement of a reed and a ligature.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
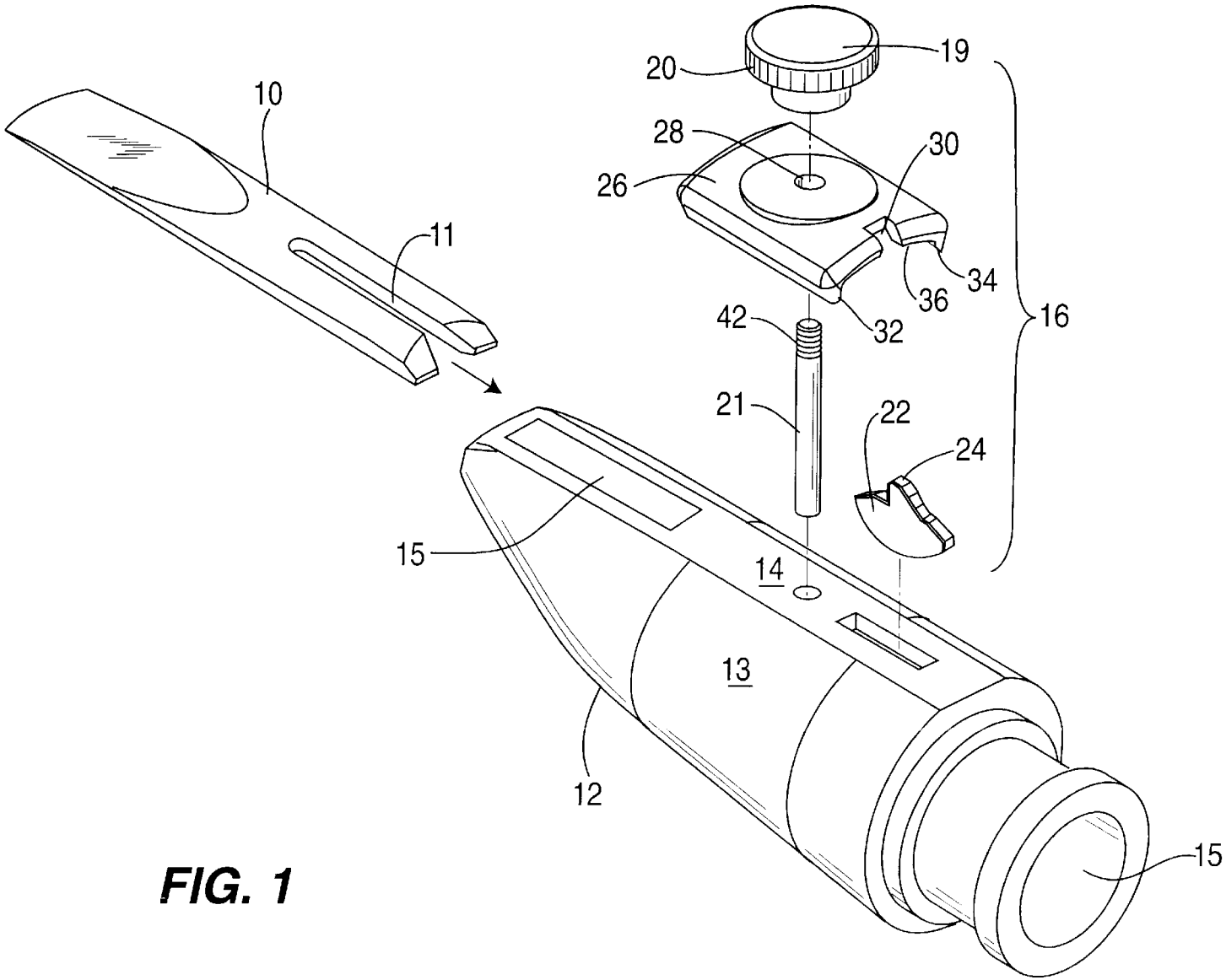
FIG. 1 is an assembly drawing in perspective showing an embodiment of the reed and mouthpiece assembly of the present invention.

The present invention provides a uniquely designed configuration for a reed and mouthpiece assembly which is self-aligning and makes replacement of a reed a quick and very easy process easily accomplished by anyone including those inexperienced or young persons who have heretofore found this activity to be difficult and time consuming. The configuration includes a reed 10 with a uniquely designed reed slot means 11 extending longitudinally therein. This reed slot 11 is mated with a configuration on the mouthpiece 12 to greatly facilitate mounting and removal thereof.

Mouthpiece 12 includes a mouthpiece body 13 which defines a reed placement surface 14 thereon. The mouthpiece body 13 defines an air conduit 15 extending therethrough through which air passes when playing a woodwind instrument which is attached with respect to the mouthpiece 12. Such woodwind instruments include clarinets and saxophones.

The reed placement surface 14 is immediate adjacent the air conduit 15 and is adapted to receive a reed 10 secured thereagainst. Conventional ligatures have been utilized for this purpose. However, the present invention provides a self-aligning reed securement means 16 which is a distinct improvement over these prior art configurations.

The self-aligning reed securement means 16 includes a tightening means 18 such as a knob 19 or the like which is engageable with respect to a thread means 42 defined on a mounting stud 21 which itself is secured to the mouthpiece body 13 at the reed placement surface 14.

In the preferred configuration mounting stud 21 is fixedly secured in the reed placement surface 14 of the mouthpiece body 13 and extends outwardly therefrom. The threaded section 42 thereof is at the outermost end of the mounting stud 21 and is engageable with the tightening knob 19. Turning of the tightening knob 19 into engagement with the threads 42 of the mounting stud 21 can be facilitated by the inclusion of a knurled exterior surface 20 on the outer area of the knob 19.

In the preferred configuration, the reed 10 can be placed onto the reed placement surface 14 with the reed slot 11 extending around the mounting stud 21 and under pressure plate 26. Then the tightening knob 19 can be tightened manually by use of the knurled exterior surface 20 thereof downwardly such that the reed 10 is held in position on the reed placement surface 14 with the reed slot 11 extending around the mounting stud 21.

To further align the reed 10 with respect to the mouthpiece 12 and therefore also with respect to the air conduit 15 an alignment means or spine 22 may be included. This alignment means or spine is preferably positioned on the reed placement surface 14 spatially disposed longitudinally from the mounting stud 21 and is also adapted to receive the reed slot 11 extending therearound. Thus with the reed slot 11 extending around both the alignment spine 22 and the mounting stud 21 automatic self-alignment of the reed 10 with respect to the reed placement surface 14 is achieved. The reed 10 can then be secured in this position by tightening of the knob means 19.

Figure 6:
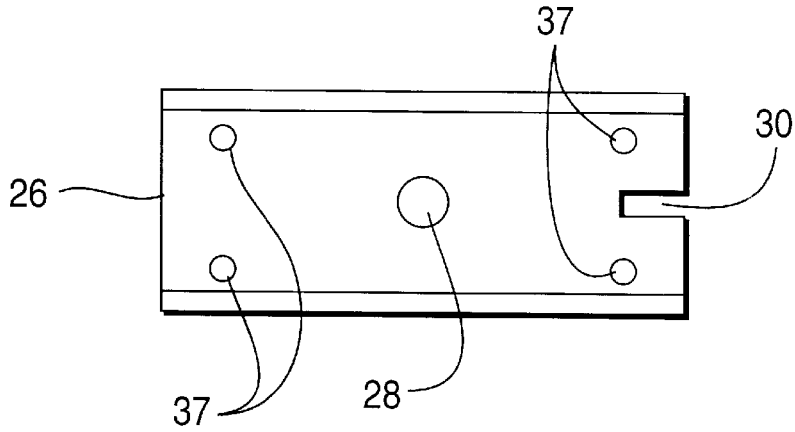
FIG. 6 is a bottom plan view of an embodiment of the pressure plate of the present invention.
Figure 7:
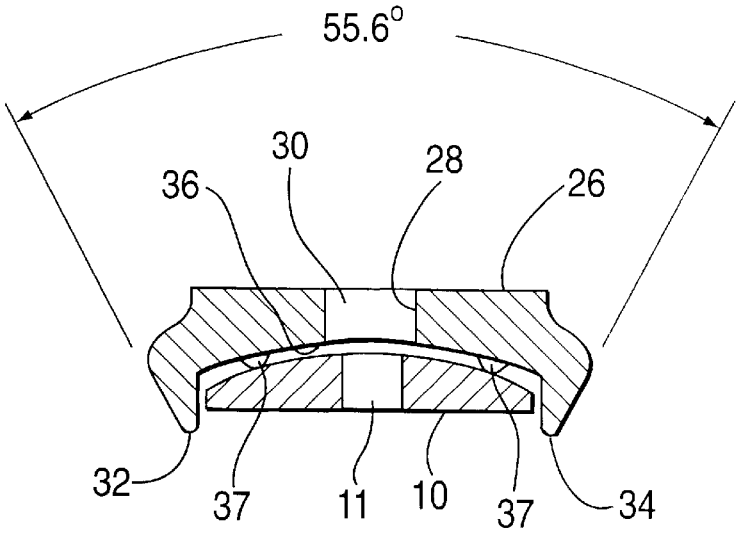
FIG. 7 is an end plan view of an embodiment of the pressure plate showing the reed retained within the reed retaining cavity.

To further facilitate alignment and securement of the reed 10 with respect to the reed placement surface 14 a pressure plate 26 shall be utilized. Pressure plate 26 will preferably extend longitudinally parallel with respect to the air conduit 15 within the reed placement surface 14 and will define a pressure plate hole 28 therein to allow mounting of the pressure plate upon the mounting stud 21. In this manner the reed will be placed below the pressure plate 26 and the tightening knob 19 will be positioned above the pressure plate 26 in such a manner that the pressure plate will more evenly distribute the downwardly directed forces from the tightening knob 19 as it is tightened upon the threads 42. Preferably the pressure plate 26 will include a first longitudinally extending leg member 32 and a second longitudinally extending leg member 34 at the outward lateral sides thereof to define a reed retaining cavity 36 in the under surface of plate 26. This reed retaining cavity 36 will be adapted to receive the reed 10 therein and maintain it in proper longitudinal orientation relative to the mouthpiece 12 and the air conduit 15. To further facilitate securement of the reed 10 with respect to the pressure plate 26 within the reed retaining cavity 36 thereof a plurality of protrusions 37 may be included as best shown in FIGS. 6 and 7 wherein four such protrusions are shown extending downwardly from pressure plate 26 into the reed retaining cavity 36 thereof for abutment and engagement with a reed 10 located therein.

It is also important that longitudinal orientation of the pressure plate 26 be maintained and this is achieved by the defining of a pressure plate notch 30 therein. Also the alignment spine means 22 will also include an upwardly extending tab 24 defined therein. This tab 24 is adapted to extend through and engage the pressure plate notch 30 when the pressure plate 26 is positioned mounted upon the mounting stud 21. In this manner longitudinal orientation of the pressure plate 26 is achieved by the combination of positioning of the mounting stud 21 and the alignment spine 22 in a similar manner to the engagement of those two same parts with respect to the reed slot 11 of a reed so positioned thereunder.

Figure 3:
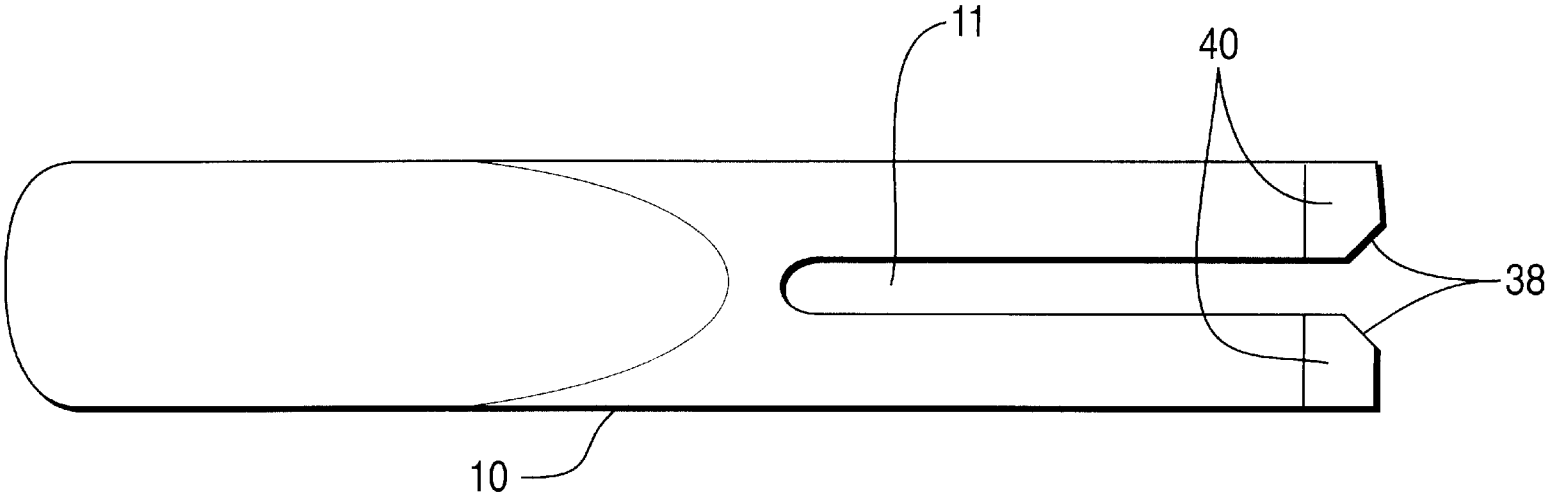
FIG. 3 is a top plan view of an embodiment of a reed for use with the present invention.
Figure 4:
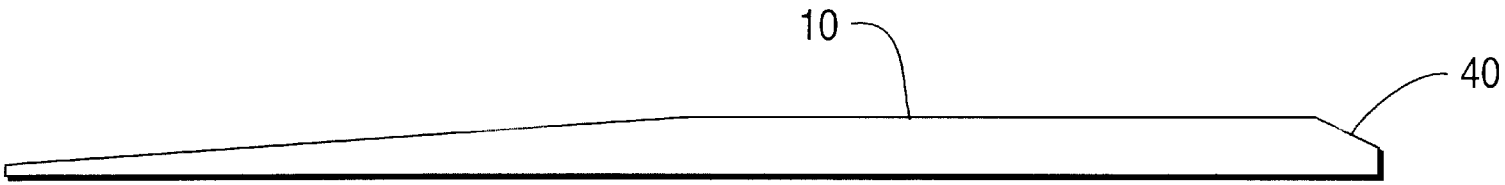
FIG. 4 is a side plan view of an embodiment of the reed shown in FIG. 3.
Figure 5:
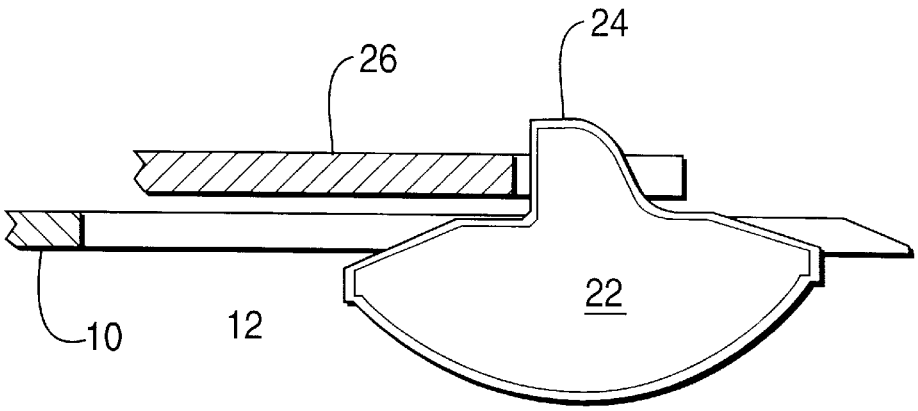
FIG. 5 is a side plan view of an embodiment of the alignment spine of the present invention shown in position in the mouthpiece with the reed and pressure plate shown in alignment with the alignment spine and tab thereof, respectively.

Ease in movement of the reed 10 into proper position on the reed placement surface 14 is further achieved by including outwardly flared areas 38 at the end of the reed slot as best shown in FIG. 3. These slightly outward flared areas at the outer extremity of the reed slot 11 will facilitate sliding movement of the reed 10 into engagement with the mounting stud 21 and will encourage engagement thereof into the reed slot 11.

Also it is preferable that the reed 10 include beveled areas in the upper portions of the reed adjacent the end of the reed slot 11. These horizontally beveled areas will facilitate movement of the reed 10 into position under the pressure plate 26 and into the reed retaining cavity 36 thereof.

Reeds used with the mouthpieces of woodwind instruments need to be installed and removed frequently. Often replacement is required in the middle of a performance and speed and ease of replacement is important. This replacement activity requires some skill and can be quite difficult especially for novice woodwind instrument players. The present invention provides a novel means for allowing extremely quick, easy and accurate reed replacement by the use of a self-alignment feature in the reed and mouthpiece assembly of the present invention.

Figure 2:
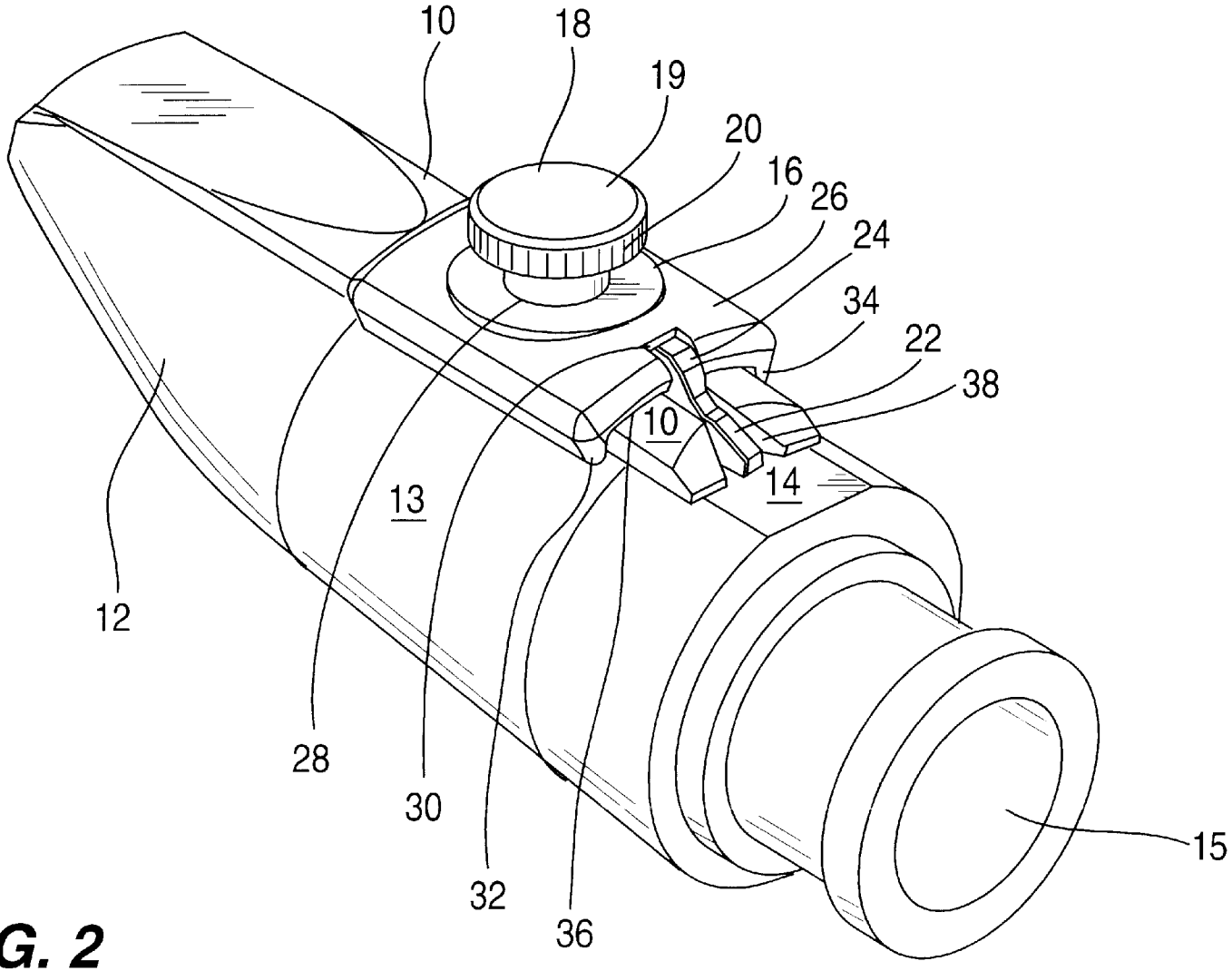
FIG. 2 is a perspective illustration of the embodiment shown in FIG. 1 shown assembled.

In use, in order to replace a reed, the user will first rotate the tightening knob 19 by gripping of the knurled external surface 20 thereof in a counterclockwise direction for loosening. This will loosen the engagement between the pressure plate 26 and the reed 10 therebelow. The musician can then move the reed to the left as shown in FIGS. 1 and 2 such that the reed slot 11 is disengaged from its position extending around the mounting stud 21 and the pressure plate 26. Once removed a new reed can be slid along the reed placement surface 14 from the left as shown in FIGS. 1 and 2. The beveled areas 40 adjacent the reed slot 11 will ease the movement of the reed 10 into the reed retaining cavity 36 below pressure plate 26. As the end of the reed is moved to the mounting stud 21 the outwardly flared areas 38 of the reed slot 11 will facilitate movement of the reed 10 into a position with the reed slot 11 surrounding the mounting stud 21. As the reed is moved further into engagement with the reed placement surface 14 the reed slot 11 will engage the alignment spine 22. Once the reed is in full proper position the tightening knob 19 can be rotated in a clockwise direction to exert pressure downwardly on the pressure plate 26 which in turn will exert downward pressure upon the reed 10 positioned within the reed retaining cavity 36 defined therebelow. Thus an extremely rapid and efficient means is provided for quickly and conveniently replacing of a reed for a woodwind instrument mouthpiece which is fully self-aligning.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A reed and mouthpiece assembly for a woodwind musical instrument comprising:

A. a mouthpiece means usable when attached a woodwind musical instrument comprising:

(1) a mouthpiece body defining an air conduit means extending therethrough for providing a vibrating column of air to facilitate playing of a woodwind musical instrument;

(2) a reed placement surface defined on said mouthpiece body adjacent said air conduit means adapted to receive a reed detachably secured thereagainst;

B. a reed means defining a reed slot means extending therewithin, said reed means adapted to be detachably secured with respect to said reed placement surface adjacent said air conduit means to control airflow therethrough;

C. a self-aligning reed securement means attached to said mouthpiece means and adapted to selectively retain said reed means in proper alignment on said reed placement surface, said self-aligning reed securement means including:

(1) a mounting stud means secured to said reed placement surface and extending outwardly therefrom, said mounting stud means adapted to extend through said reed slot means to facilitate alignment thereof when said reed means is positioned on said reed placement surface; and (2) a tightening means being securable to said mounting stud means and movable with respect thereto, said tightening means adapted to selectively exert a force toward said reed means for retaining thereof in engagement with respect to said reed placement surface with said reed means positioned with said mounting stud means extending through said reed slot means.

2. A reed and mouthpiece assembly for a woodwind musical instrument as defined in claim 1 wherein said reed means is adapted to be detachably secured upon said reed placement surface with said reed slot means oriented extending parallel with respect to said air conduit means.

3. A reed and mouthpiece assembly for a woodwind musical instrument as defined in claim 1 wherein said self-aligning reed securement means includes an alignment means extending outwardly from said reed placement surface to be positionable within said reed slot means of said reed means when positioned upon said reed placement surface to enhance alignment therebetween.

4. A reed and mouthpiece assembly for a woodwind musical instrument as defined in claim 3 wherein said alignment means comprises an alignment spine means extending outwardly from said reed placement surface.

5. A reed and mouthpiece assembly for a woodwind musical instrument as defined in claim 4 wherein said alignment spine means is positioned spatially disposed from said mounting stud means on said reed placement surface and extends parallel with respect to said reed slot means when said reed means is positioned upon said reed placement surface.

6. A reed and mouthpiece assembly for a woodwind musical instrument as defined in claim 3 wherein said alignment spine means is oriented parallel with respect to said air conduit means defined within said mouthpiece body.

7. A reed and mouthpiece assembly for a woodwind musical instrument as defined in claim 1 wherein said mounting stud means includes mounting thread means thereon engageable with respect to said tightening means.

8. A reed and mouthpiece assembly for a woodwind musical instrument as defined in claim 7 wherein said tightening means comprises a knob means engageable with respect to said mounting thread means of said mounting stud means to facilitate exerting of force toward said reed means for retaining thereof in engagement with respect to said reed placement surface of said mouthpiece means.

9. A reed and mouthpiece assembly for a woodwind musical instrument as defined in claim 8 wherein said knob means is adjustably positionable with respect to said mounting thread means of said mounting stud means to facilitate adjustable control of the amount of force retaining said reed means in engagement with respect to said reed placement surface.

10. A reed and mouthpiece assembly for a woodwind musical instrument as defined in claim 9 wherein said knob means includes a knurled external surface extending therearound to facilitate tightening and loosening thereof manually.

11. A reed and mouthpiece assembly for a woodwind musical instrument as defined in claim 1 wherein said reed slot means of said reed means is outwardly flared in order to facilitate alignment thereof with respect to said mounting stud means.

12. A reed and mouthpiece assembly for a woodwind musical instrument as defined in claim 11 wherein said reed means is beveled downwardly adjacent said reed slot means thereof to facilitate positioning thereof in abutment with said self-aligning securement means.

13. A reed and mouthpiece assembly for a woodwind musical instrument as defined in claim 1 wherein said reed placement surface is oriented extending parallel with respect to said air conduit means.

14. A reed and mouthpiece assembly for a woodwind musical instrument as defined in claim 1 wherein said self-aligning reed securement means further includes a pressure plate means positioned between said tightening means and said reed means to facilitate retaining thereof in position upon said reed placement surface, said pressure plate means defining a pressure plate hole means extending therethrough, said pressure plate hole means adapted to receive said mounting stud means extending therethrough to facilitate placement thereof between said tightening means and said reed means.

15. A reed and mouthpiece assembly for a woodwind musical instrument as defined in claim 14 wherein said pressure plate means includes a first leg member and a second leg member extending downwardly therefrom with each extending longitudinally therealong spatially disposed from one another to define therebetween a reed retaining cavity means within said pressure plate means to facilitate holding of said reed means therewithin.

16. A reed and mouthpiece assembly for a woodwind musical instrument as defined in claim 15 wherein said pressure plate means includes a protrusion means extending into said reed retaining cavity means between said first leg member and said second leg member adapted to abut said reed means when positioned within said reed retaining cavity means to facilitate holding thereof.

17. A reed and mouthpiece assembly for a woodwind musical instrument as defined in claim 16 wherein said self-aligning reed securement means includes an alignment spine means extending outwardly from said reed placement surface to be positionable within said reed slot means of said reed means when positioned upon said reed placement surface to enhance alignment therebetween and wherein said alignment spine means further defines a tab means extending outwardly therefrom and wherein said pressure plate means defines a pressure plate notch means within said reed retaining cavity means, said tab means of said alignment spine means being positionable within said pressure plate notch means to maintain longitudinal alignment between said pressure plate means, said alignment spine means and said reed means.

18. A reed and mouthpiece assembly for a woodwind musical instrument as defined in claim 14 wherein said reed means is beveled downwardly adjacent said reed slot means thereof to facilitate movement thereof beneath said pressure plate means to facilitate alignment in positioning of said reed means on said reed placement surface of said mouthpiece means.

19. A reed and mouthpiece assembly for a woodwind musical instrument comprising:

A. a mouthpiece means usable when attached a woodwind musical instrument comprising:

(1) a mouthpiece body defining an air conduit means extending therethrough for providing a vibrating air column to facilitate playing of a woodwind musical instrument;

(2) a reed placement surface defined on said mouthpiece body adjacent said air conduit means adapted to receive a reed detachably secured thereagainst, said reed placement surface being oriented extending parallel with respect to said air conduit means;

B. a reed means defining a reed slot means extending therewithin, said reed means adapted to be detachably secured with respect to said reed placement surface adjacent said air conduit means to control airflow therethrough, said reed means being adapted to be detachably secured upon said reed placement surface with said reed slot means oriented extending parallel with respect to said air conduit means;

C. a self-aligning reed securement means attached to said mouthpiece means and adapted to selectively retain said reed means in proper alignment on said reed placement surface, said self-aligning reed securement means including:

(1) a mounting stud means secured to said reed placement surface and extending outwardly therefrom, said mounting stud means adapted to extend through said reed slot means to facilitate alignment thereof when said reed means is positioned on said reed placement surface, said mounting stud means including a mounting thread means thereon;

(2) a tightening means engageable with respect to said mounting thread means and being detachably securable to said mounting stud means and movably therealong, said tightening means adapted to selectively exert a force toward said reed means for retaining thereof in engagement with respect to said reed placement surface with said reed means positioned with said mounting stud means extending through said reed slot means, said tightening means including a knob means engageable with respect to said mounting thread means of said mounting stud means to facilitate exerting of force toward said reed means for retaining thereof in engagement with respect to said reed placement surface of said mouthpiece means, said knob means being adjustably positionable with respect to said mounting thread means of said mounting stud means to facilitate adjustable control of the amount of force retaining said reed means in engagement with respect to said reed placement surface;

(3) an alignment spine means extending outwardly from said reed placement surface to be positionable within said reed slot means of said reed means when positioned upon said reed placement surface to enhance alignment therebetween; and (4) a pressure plate means positioned between said tightening means and said reed means to facilitate retaining thereof in position upon said reed placement surface, said pressure plate means defining a pressure plate hole means extending therethrough, said pressure plate hole means adapted to receive said mounting stud means extending therethrough to facilitate placement thereof between said tightening means and said reed means.

20. A reed and mouthpiece assembly for a woodwind musical instrument comprising:

A. a mouthpiece means usable when attached a woodwind musical instrument comprising:

(1) a mouthpiece body defining an air conduit means extending therethrough for providing a vibrating column of air to facilitate playing of a woodwind musical instrument;

(2) a reed placement surface defined on said mouthpiece body adjacent said air conduit means adapted to receive a reed detachably secured thereagainst, said reed placement surface being oriented extending parallel with respect to said air conduit means;

B. a reed means defining a reed slot means extending therewithin, said reed means adapted to be detachably secured with respect to said reed placement surface adjacent said air conduit means to control airflow therethrough, said reed means being adapted to be detachably secured upon said reed placement surface with said reed slot means oriented extending parallel with respect to said air conduit means, said reed slot means of said reed means being outwardly flared in order to facilitate alignment thereof, said reed means being beveled downwardly adjacent said reed slot means thereof to facilitate movement thereof into alignment on said reed placement surface of said mouthpiece means;

C. a self-aligning reed securement means attached to said mouthpiece means and adapted to selectively retain said reed means in proper alignment on said reed placement surface, said self-aligning reed securement means including:

(1) a mounting stud means secured to said reed placement surface and extending outwardly therefrom, said mounting stud means adapted to extend through said reed slot means to facilitate alignment thereof when said reed means is positioned on said reed placement surface, said mounting stud means including a mounting thread means thereon;

(2) a tightening means engageable with respect to said mounting thread means and being detachably securable to said mounting stud means and movably therealong, said tightening means adapted to selectively exert a force toward said reed means for retaining thereof in engagement with respect to said reed placement surface with said reed means positioned with said mounting stud means extending through said reed slot means, said tightening means including a knob means engageable with respect to said mounting thread means of said mounting stud means to facilitate exerting of force toward said reed means for retaining thereof in engagement with respect to said reed placement surface of said mouthpiece means, said knob means being adjustably positionable with respect to said mounting thread means of said mounting stud means to facilitate adjustable control of the amount of force retaining said reed means in engagement with respect to said reed placement surface, said knob means including a knurled external surface extending therearound to facilitate tightening and loosening thereof manually;

(3) an alignment spine means extending outwardly from said reed placement surface to be positionable within said reed slot means of said reed means when positioned upon said reed placement surface to enhance alignment therebetween, said alignment spine means being oriented extending parallel with respect to said reed slot means and said air conduit means responsive to said reed means being positioned upon said reed placement surface, said alignment spine means further defining a tab means extending outwardly therefrom;

(4) a pressure plate means positioned between said tightening means and said reed means to facilitate retaining thereof in position upon said reed placement surface, said pressure plate means defining a pressure plate hole means extending therethrough, said pressure plate hole means adapted to receive said mounting stud means extending therethrough to facilitate placement thereof between said tightening means and said reed means, said pressure plate means defining a pressure plate notch means to receive said tab means of said alignment spine means positioned therewithin to maintain longitudinal alignment between said pressure plate means, said alignment spine means and said reed means, said pressure plate means further including:

(a) a first leg member extending downwardly and longitudinally therealong;

(b) a second leg member extending downwardly and longitudinally therealong at a position spatial disposed from said first leg member to define therebetween a reed retaining cavity means within said pressure plate means to facilitate holding of said reed means therewithin; and (c) a protrusion means extending into said reed retaining cavity means between said first leg member and said second leg member adapted to abut said reed means when positioned within said reed retaining cavity means to facilitate holding thereof.

* * * * *